United States Patent [19]

Huettenhain et al.

[11] Patent Number: 5,066,310

[45] Date of Patent: Nov. 19, 1991

[54] METHOD FOR RECOVERING LIGHT HYDROCARBONS FROM COAL AGGLOMERATES

[75] Inventors: Horst Huettenhain, Benicia; August D. Benz, Hillsborough, both of Calif.; John Getsoian, Ann Arbor, Mich.

[73] Assignees: Bechtel Group, Inc., San Francisco, Calif.; Arcanum Corp., Ann Arbor, Mich.

[21] Appl. No.: 566,634

[22] Filed: Aug. 13, 1990

[51] Int. Cl.[5] ..... C10L 5/00

[52] U.S. Cl. ..... 44/500; 44/505; 44/620; 44/621; 44/626

[58] Field of Search ..... 44/505, 500, 620, 621, 44/626

[56] References Cited

U.S. PATENT DOCUMENTS

| | | | |
|---|---|---|---|
| 4,018,571 | 4/1977 | Cole et al. . | |
| 4,033,729 | 7/1977 | Capes et al. . | |
| 4,102,968 | 7/1978 | Caswell . | |
| 4,173,530 | 11/1979 | Smith et al. . | |
| 4,209,301 | 6/1980 | Nicol et al. . | |
| 4,213,779 | 7/1980 | Caswell . | |
| 4,255,155 | 3/1981 | Frankovich . | |
| 4,294,584 | 10/1981 | Verschuur | 44/568 |
| 4,396,396 | 8/1983 | Mainwaring . | |
| 4,415,335 | 11/1983 | Mainwaring et al. | 44/621 |
| 4,447,245 | 5/1984 | Smith et al. . | |
| 4,484,928 | 11/1984 | Keller, Jr. . | |
| 4,501,551 | 2/1985 | Riess et al. | 44/505 |
| 4,539,010 | 9/1985 | Mainwaring et al. | 44/505 |
| 4,559,060 | 12/1985 | Muroi et al. . | |
| 4,854,940 | 8/1989 | Janiak et al. | 44/620 |
| 4,874,393 | 10/1989 | Mikhlin et al. . | |

FOREIGN PATENT DOCUMENTS

| | | | |
|---|---|---|---|
| 0162694 | 9/1983 | Japan | 44/505 |

*Primary Examiner*—Prince Willis, Jr.
*Assistant Examiner*—R. D. Flatter
*Attorney, Agent, or Firm*—Townsend and Townsend

[57] ABSTRACT

A method and apparatus for removing light hydrocarbons, such as heptane, from coal agglomerates includes an enclosed chamber having a substantially horizontal perforate surface therein. The coal agglomerates are introduced into a water bath within the chamber. The agglomerates are advanced over the surface while steam is substantially continuously introduced through the surface into the water bath. Steam heats the water and causes volatilization of the light hydrocarbons, which may be collected from the overhead of the chamber. The resulting agglomerates may be collected at the opposite end from the surface and subjected to final draining processes prior to transportation or use.

23 Claims, 2 Drawing Sheets

METHOD FOR RECOVERING LIGHT HYDROCARBONS FROM COAL AGGLOMERATES

This invention was made with Government support under Contract No. DE-AC22-87PC79867 awarded by the Department of Energy. The Government has certain rights in this invention.

BACKGROUND OF THE INVENTION

1. Field of the Invention

The present invention relates generally to methods and apparatus for recovering volatile liquids from particulate materials. More particularly, the present invention relates to processes and equipment for recovering hydrocarbons from coal agglomerates where the hydrocarbons have been used as a bridging liquid in agglomerate formation.

Size enlargement of particles contained in a slurry may be performed for a variety of purposes, including filtration, dewatering, settling, and the like. In one type of size enlargement process, a bridging liquid is combined in a liquid suspension of fine particles. By agitating the suspension, the bridging liquid acts to selectively wet the surfaces of the particles causing the desired agglomeration. Of particular interest to the present invention, are coal agglomeration processes where coal fines suspended in a water slurry are combined with hydrocarbon liquid and subjected to agitation. The resulting size enlargement of the coal greatly facilitates handling characteristics and significantly reduces wastage.

Coal processing frequently involves washing to remove various mineral and inorganic substances which can cause "ash" on subsequent burning. The formation and loss of fine coal particles is an unfortunate side effect of such washing processes. Such loss of coal is not only wasteful, it also causes secondary water pollution.

The coal fines resulting from washing are usually contained in a tailing stream from the primary washing process. An effective approach for removing the coal fines is known as "selective agglomeration" where coal is extracted from the aqueous suspension medium using hydrocarbons as a bridging liquid, as described above.

A particularly effective coal fines agglomeration process has been developed by the Arcanum Corporation, Ann Arbor, MI. In a two-step process, heptane is first added to a coal-water slurry to initiate aggregation and cause the formation of "micro-agglomerates." In the second step, a heptane-asphalt mixture is combined with the micro-agglomerates to cause further size enlargement, typically to a final size in the range from about 3 to 8 millimeters. With this size, the water and dispersed minerals may easily be removed from the agglomerates.

Heptane, however, is a volatile, flammable, and expensive material which must be removed from the agglomerates for both safety and economic reasons. After removal of the heptane, the coal agglomerates will remain bound by the presence of asphalt which was introduced in the second step. The removal of heptane from the agglomerates may be achieved by applying heat to evaporate the heptane which can then be collected and recovered. The use of steam in a batch process for the recovery of heptane has been demonstrated, however, under batch conditions, direct steam heating can cause sticking and lumping in the stationary bed of solids, requiring increased processing time and making the final product more difficult to transport and manipulate. Direct steam heating can also cause excessive thermal gradients in agglomerate particles which can result in vapor evolution at rates sufficient to rupture said particles. Furthermore, a continuous processing system would have well known economic advantages over a batch system.

For these reasons, it would be desirable to provide methods and apparatus for recovering heptane and other hydrocarbons from coal agglomerates where hydrocarbons have been used as a bridging liquid. It would be further desirable if such methods and apparatus utilized steam and/or other sources of heat, but minimized the shortcomings of the aforementioned batch process. Such methods and apparatus should provide a relatively non-sticky, free flowing product to facilitate subsequent handling and combustion, while recovery of the heptane and light hydrocarbons should be performed under conditions which minimize the likelihood of fire and explosion. Finally, substantial recovery of heptane and/or other light hydrocarbons should be achieved, preferably being greater than 98%, more preferably being greater than 99%.

2. Description of the Background Art

Size enlargement (agglomeration) of fine coal particles using hydrocarbon oils as a bridging liquid is taught in U.S. Pat. Nos. 4,033,729 and 4,874,393. A method for deashing coal which has been agglomerated with a hydrocarbon liquid is described in U.S. Pat. No. 4,396,396, where the hydrocarbon liquid may be recovered by vacuum stripping, with or without superheated steam. Other processes for washing and agglomerating coal particles are described in U.S. Pat. Nos. 4,559,060; 4,484,928; 4,447,245; 4,255,155; 4,209,301; 4,173,530; and 4,081,571. U.S. Pat. No. 4,102,968 teaches a method for agglomerating sulfur particles with molten sulfur, and U.S. Pat. No. 4,213,779, teaches a method for agglomerating iron wastes with organic bridging liquids. The disclosures of each of these patents are incorporated herein by reference.

SUMMARY OF THE INVENTION

According to the present invention, light hydrocarbons such as heptane are removed from coal agglomerates, where the light hydrocarbons have been used as a bridging liquid in agglomerate formation. The coal agglomerates are immersed in water, and the resulting agglomerate-water mixture is heated, preferably by steam contact, under conditions selected to evaporate substantially all of the light hydrocarbons. As steam is applied to the agglomerate-water mixture, the heat energy of the steam is rapidly and completely absorbed into the water, which in turn imparts heat to the agglomerates in a more gentle and uniform manner than direct steam contact (i.e., contact where the agglomerates are not immersed). The water also suspends and stabilizes the agglomerates during heating. These effects have been found to reduce the tendency of the coal agglomerates to stick together to form "lumps" and to reduce the production of undesirable fines due to burst agglomerates, both as described above. The light hydrocarbons are recovered from a water-hydrocarbon vapor which results from the steam heating.

In a preferred aspect, the method of the present invention is continuous. The coal agglomerates and water are introduced into a water bath, and the agglomerates are advanced through an evaporation zone in said water bath. Steam is continuously introduced into the water bath throughout the evaporation zone to produce a vapor phase which is collected above the zone. The vapor phase is collected and the hydrocarbons may be recovered from the vapor phase by conventional techniques.

In a second preferred aspect of the method of the present invention, the coal agglomerates are introduced into a water bath with a chamber maintained at an elevated temperature at one end of a substantially horizontal perforate surface within the chamber. Coal agglomerates are advanced through the bath over the perforate surface while steam is introduced substantially uniformly through the bottom of the surface. The upward steam flow prevents weeping (i.e., prevents drainage or leakage of the water downward through the perforations in the surface) and bubbles upward to heat the water. The length of the surface, rate at which the agglomerates are advanced, amount of steam introduced, the depth of the water bath, and the like, may all be selected in order to effect the desired level of removal and recovery of hydrocarbons. Such a continuous method within an enclosed chamber is particularly advantageous in that it facilitates handling of the agglomerates and reduces the likelihood of heptane escape and/or unintended combustion of the heptane.

Apparatus according to the present invention comprises an evaporator including an enclosed chamber having an elongate, perforate surface disposed horizontally therein. A rotary valve or other isolating means for introducing coal agglomerates and water is disposed in the chamber proximate one end of the elongate perforate surface. Means for advancing the agglomerates along the upper side of the elongate perforate surface, such as a drag chain with perforated flights, is provided so that the agglomerates may be advanced through the water bath at a desired rate to the other end of the surface. Means for introducing steam upward through the surface perforations, such as steam plenums, are provided on the underside of the surface. In this way, steam can be uniformly introduced to the water bath and heat applied to the agglomerates as they are advanced across the surface. At the far end of the surface, substantially all recoverable light hydrocarbons will have been evaporated from the coal agglomerates, and the coal agglomerates will be collected from the chamber through a second rotary valve or other isolating valve means. The resulting hydrocarbon-water vapor phase may be collected above the water bath, typically through a collection port at the upper end of the chamber. Optionally, the evaporator may further include means for draining the coal from the water bath prior to discharge from the chamber.

DESCRIPTION OF THE PREFERRED EMBODIMENTS

Figure 1:
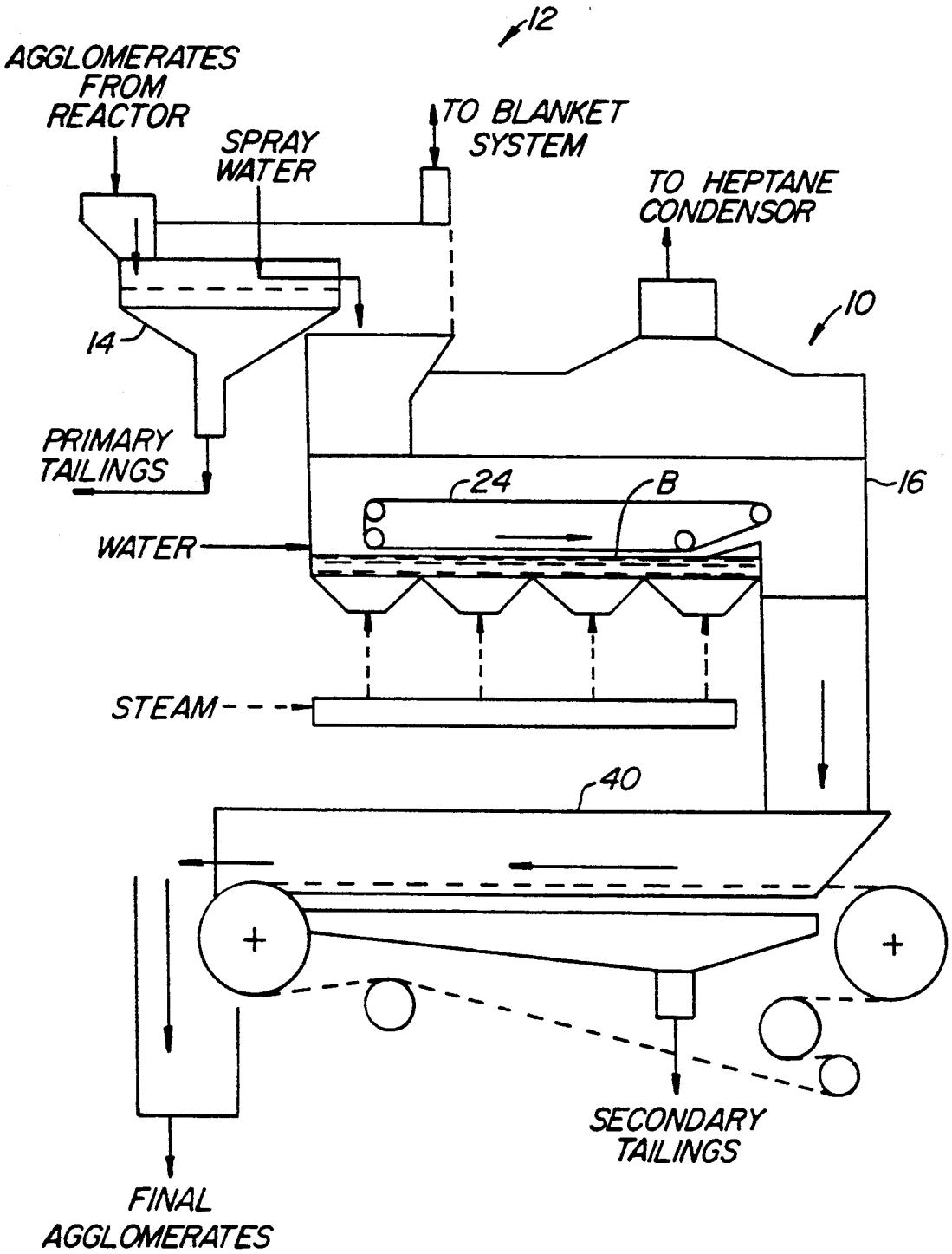
FIG. 1 illustrates a hydrocarbon recovery system employing an evaporator constructed in accordance with the principles of the present invention.

The present invention provides both methods and apparatus for evaporating and recovering light hydrocarbons from coal agglomerates, where the light hydrocarbons have been introduced to the agglomerates during size enlargement processes. In particular, the coal agglomerates may be formed by size enlargement of coal fines having a particle size which is typically below about 0.5 mm, more typically being in the range from about 0.002 mm to 0.15 mm. The coal fines may be derived from virtually any type of coal, including brown coals, lignitic coals, subbituminous coals (including A coal, B coal, and C coal), bituminous coals (including high-volatile A coal, high-volatile B coal, high-volatile C coal, medium-volatile coal, and low-volatile coal), semi-anthracitic coals, and anthracitic coals. The coal fines may also be derived from washing plants where the coal is washed with water or other liquids in order to remove mineral and other inorganic constituents to upgrade the quality of the coal. Most commonly, the coal fines subjected to size enlargement will be derived from wash plant effluents, tailings ponds, coal slurry pipeline terminal effluents, or coal grinding systems designed to produce fine coal in which the mineral constituents have been liberated from the coal by fine grinding for the purpose of rendering them separable from the coal by the agglomeration process.

The size enlargement process used to produce the coal agglomerates treated by the present invention may employ a wide variety of light hydrocarbons as the bridging liquid. Typically, the light hydrocarbons will be alkanes having a carbon chain length in the range from $C_4$ to $C_{12}$, more typically being in the range from about $C_5$ to $C_{10}$, and most typically being heptane ($C_7$), and mixtures thereof. The agglomerates may, however, be formed using other light hydrocarbons and hydrocarbon derivatives, such as halogenated hydrocarbons, as the bridging liquid. A variety of suitable hydrocarbon bridging liquids are described in the background patents which have previously been incorporated herein by reference.

In an exemplary method for forming coal agglomerates suitable for treatment by the present invention, coal fines are collected in the tailings of a coal washing process. The coal fines are combined in the slurry having a solid content in the range from about 15% to 25% by weight. Heptane is combined in the slurry at from about 18% to 30% by weight of coal, and the slurry is subjected to high shear agitation, typically using a turbine mixer at a mixing rate in the range from about 10 m/sec to 25 m/sec peripheral velocity. The coal fines are selectively wetted by the heptane and combined together to form "micro-agglomerates" having a particle size in the range from about 0.1 mm to 1.5 mm. The free mineral and other inorganic constituents originally present remain in the water phase.

After formation of the micro-agglomerates, asphalt (heavy residual oil) dissolved in heptane (usually at a concentration of about 30% by weight of asphalt in heptane) is added to the slurry such that the final concentrations of heptane and asphalt in the coal agglomerates are 20% to 45% and 2% to 5% by weight, respectively. The resulting suspension is then subjected to low shear agitation, typically using a turbine mixer at from about 80 to 120 rpm. Such low shear agitation enhances growth of the micro-aggregates and is continued until the agglomerates reach a desired size, typically in the range from about 3 to 8 mm. At this size, the coal agglomerates may be easily washed, dewatered, and separated by gravity to remove the mineral and other inorganic constituents. The heptane remains within the agglomerates as the bridging liquid. Because of its volatility, however, the heptane must be removed and desirably recovered prior to transport and/or use of the coal agglomerates. The method and apparatus of the present invention are used for such removal and recovery of the heptane or other light hydrocarbons in the coal agglomerates.

The present invention relies on immersing the resulting coal agglomerates in water and heating the resulting suspension, typically with steam, to volatilize the heptane and/or other light hydrocarbons present in the agglomerates. In the case of the exemplary agglomerates described above, the less volatile asphalt component will remain as a binder to ensure structural integrity of the agglomerates during subsequent handling and utilization. Heating of the agglomerates while immersed in water mediates heat transfer and tends to keep agglomerates suspended from one another, thus reducing the tendency of the agglomerates to break, stick or lump together (which can result from the direct exposure to steam or heated surfaces, e.g., using a heat exchanger). Moreover, heat of the agglomerates in the presence of liquid phase and vapor phase water increases the activity coefficient (volatility) of the hydrocarbon which enhances their removal.

It will be understood that the operation of the present invention does not particularly depend on the total system pressure, which may be anywhere from below atmospheric to 100 kilopascals gauge or more and which pressure will be determined by the nature of the particular devices which may be used downstream of the present invention for subsequent handling of the water and hydrocarbon vapor collected. In a preferred aspect, total system pressure may be in the range of 2 to 20 kilopascals. When steam is used as the heating source, steam will be introduced to the water bath at a temperature typically in the range from about 100° C. to about 135° C., more typically being in the range from 120° C. to 125° C., and with a differential pressure across the apparatus in the range of about 1 to 15 kilopascals, more typically with a differential pressure across the apparatus in the range from 2 to 5 kilopascals. The steam will be introduced in an amount sufficient to achieve the desired volatilization, typically being introduced in an amount in the range from about 0.3 kg steam per kg of agglomerates (dry basis) to about 1.0 kg steam per kg agglomerates (dry basis), more typically being in the range from about 0.5 kg steam per kg agglomerates (dry basis) to 0.8 kg steam per kg agglomerates (dry basis).

Preferably, the coal agglomerates will be continuously advanced through the water bath over a surface, usually a horizontal surface, maintained within an enclosed chamber at a preselected temperature, typically in the range from about 80° C. to 120° C. Steam will be continuously introduced to the slurry while it is being advanced, the slurry will have a depth typically in the range from about 50 to 300 mm, more typically being in the range from about 150 to 250 mm. The length of the surface over which the agglomerates are advanced will be selected to achieve the desired substantially complete volatilization of the hydrocarbons, conveniently being in the range from about 3 to 10 meters, more usually being in the range from about 5 to 8 meters. The rate of advance of the agglomerates over the surface will, of course, depend both on the depth of the water bath and the length of the surface, usually being in the range from about 0.1 m/min to about 1 m/min, more usually being in the range from about 0.15 m/min to about 0.35 m/min. The width of the surface will be selected to provide a desired capacity for the system, typically being in the range from about 1 meter wide to about 3 meters wide. Usually, the surface will be perforate having a network of apertures which allow steam applied to the bottom of the surface to rise upward into the water bath. The apertures will normally be provided uniformly over the surface, typically having dimensions (diameter) in the range from about 1 mm to about 6 mm, more typically in the range from about 2 mm to about 4 mm and being present at a number from about 150 apertures/$m^2$ to about 1000 apertures/$m^2$. As an alternative to the perforations, a sparging system could be provided over the support surface or as an additional alternative, the horizontal surface could be partially comprised of porous metal sections.

Figure 2:
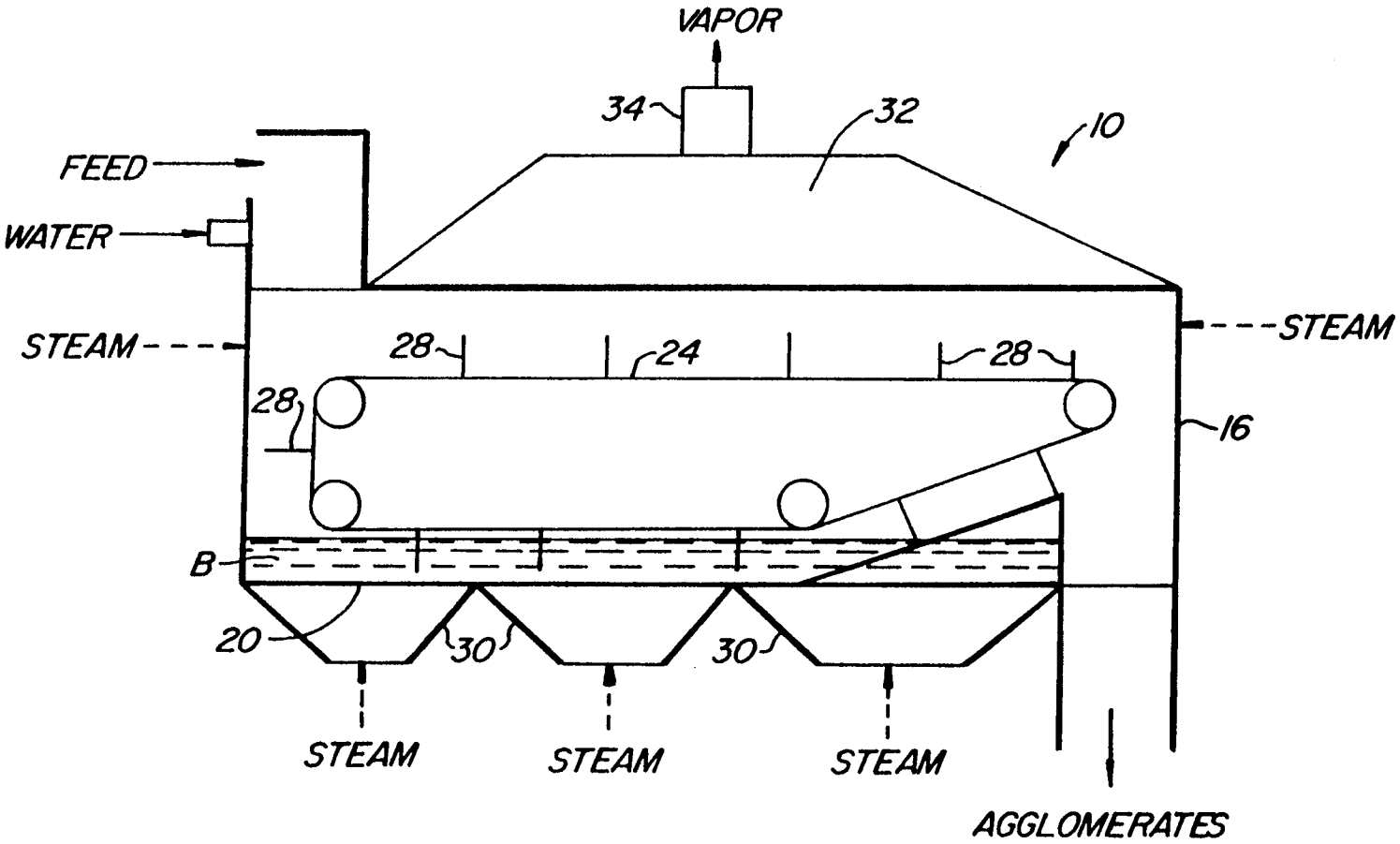
FIG. 2 illustrates the evaporator employed in the system of FIG. 1 in greater detail.

Referring now to FIGS. 1 and 2, an exemplary apparatus for performing the method of the present invention will be described. The apparatus includes an evaporator 10 (FIG. 2) which is incorporated within a treating system 12 (FIG. 1) which further includes a primary wash unit 14 which receives the coal agglomerates from a suitable reactor (described above) and subjects the agglomerates to a water spray to remove any remaining fines, minerals, and other inorganic constituents. The washed coal agglomerates are then fed to an enclosed chamber 16 which forms the evaporator vessel. The coal agglomerates are usually although not necessarily fed through an isolation inlet valve, typically a rotary valve, after being combined with a clean make-up water stream. The agglomerates and make-up water drop into a water bath B having a desired depth on a bottom surface 20 of the chamber 16. The bottom surface 20 is perforate, having a plurality of apertures, as described above. The depth of the water bath B on the perforate surface 20 is usually determined by an outlet isolation valve, weir, or the like, located at the opposite end of the surface. The outlet isolation valve may also typically be a rotary valve.

A mechanism for advancing the agglomerates at a uniform rate over the perforate surface 20 will be provided. The mechanism is conveniently a drag chain 24 comprising a continuous belt 26 having a plurality of perforated flights 28 which sweep the agglomerates through the bath and over the perforate surface 20 as the belt 24 is continuously rotated.

Steam is continuously introduced to the water bath through steam plenums 30 disposed on the bottom of the perforate surface. While a plurality of separate stem plenums are illustrated, it will be appreciated that a single plenum having internal baffling might also be utilized in order to obtain a substantially uniform steam pressure beneath the perforate surface 20. The differential pressure across the apparatus will typically be in the range from about 1 kilopascal to about 15 kilopascals, more typically being in the range from 2 kilopascals to 5 kilopascals and will be sufficient to prevent weeping of water from the bath on the upper side of the surface 20.

The introduction of steam through the perforate surface 20 into the water bath will raise the temperature of the water which in turn will uniformly heat the coal agglomerates sufficiently to cause volatilization of the heptane in the agglomerates, typically being in the range from about 60° C. to about 120° C., more typically being in the range from about 80° C. to about 100° C. The steam will also cause water vapor to rise from the slurry, and both the volatilized hydrocarbons and the water vapor will rise into overhead section 32 of the chamber 16 where they are collected and released through a suitable vent 34.

The heptane or other light hydrocarbon may be recovered from the hydrocarbon-water vapor phase by conventional recovery techniques, such as condensation and decantation using heat exchangers, optionally with chilled water supply, and oil-water separators. The coal agglomerates which have had the hydrocarbon liquids removed therefrom are discharged with some water through rotary valve 22 onto a drainage conveyor belt 40 where they will be typically cooled by a water spray (not illustrated). The water drains from the belt 40 and is collected for removal of the tailings. After draining, the final agglomerates are collected for subsequent transportation and/or use.

Although the foregoing invention has been described in detail for purposes of clarity of understanding, it will be obvious that certain modifications may be practiced within the scope of the appended claims.

What is claimed is:

1. A method for recovering light hydrocarbons used as a bridging liquid from agglomerated coal particles, said method comprising:

immersing the agglomerated coal particles in water;

heating the immersed agglomerated coal particles under conditions selected to remove substantially all light hydrocarbons from said agglomerated coal particles, whereby a vapor phase containing water vapor and light hydrocarbon vapor is produced; and recovering the light hydrocarbons from the vapor phase.

2. A method as in claim 1, wherein the light hydrocarbons include primarily heptane.

3. A method as in claim 1, wherein the water is in an environment maintained at a temperature in the range from about 60° C. to 120° C.

4. A method as in claim 1, wherein the immersed coal particles are heated by contacting the water with steam.

5. A method as in claim 4, wherein the steam is bubbled upward through the water.

6. A method as in claim 1, further comprising draining water from the coal agglomerates and collecting the drained coal agglomerates.

7. A method for recovering light hydrocarbons used as a bridging liquid from a continuous flow of agglomerated coal particles, said method comprising:

introducing the agglomerated coal particles to a water bath;

advancing the agglomerated coal particles through an evaporation zone while the coal particles remain substantially immersed in the water bath;

introducing steam into the evaporation zone, whereby a vapor phase containing water vapor and light hydrocarbon vapor is produced; and recovering the light hydrocarbon from the vapor phase.

8. A method as in claim 7, wherein the agglomerated coal particles are introduced at an inlet end of an elongate evaporation zone and advanced axially to an outlet end of the evaporation zone, and wherein the rate at which the agglomerated coal particles are advanced and the rate at which steam is introduced to the evaporation zone are selected to remove substantially all the light hydrocarbons from the agglomerated coal particles.

9. A method as in claim 8, wherein the water bath has a depth in the range from about 50 mm to 300 mm.

10. A method as in claim 9, wherein the steam is at a temperature in the range from about 100° C. to 135° C. and a steam pressure in the range from about 1 kilopascal to 15 kilopascals is maintained.

11. A method as in claim 10, wherein the steam is introduced at a rate in the range from about 0.3 kg steam per kg of coal agglomerates (dry basis) to 1 kg steam per kg of coal agglomerates (dry basis).

12. A method as in claim 11, wherein the agglomerates are advanced over a length in the range from about 3 meters to 10 meters and at a rate in the range from about 0.1 m/min to 1 m/min.

13. A method as in claim 7, wherein the light hydrocarbons include primarily heptane, the water bath is about 50 millimeters to 300 millimeters deep, the steam is at a temperature in the range from about 100° C. to 135° C., and at a differential pressure across the apparatus in the range from about 1 kilopascal to 15 kilopascals, the steam is introduced at a rate in the range from about 0.3 kg of steam per kg of coal agglomerates (dry basis) to 1.0 kg of steam per kg of coal agglomerates (dry basis), and the agglomerates are advanced over a length in the range from about 3 meters to 10 meters and at a rate in the range from about 0.1 meter per minute to 1 meter per minute.

14. In a process for agglomerating coal fines wherein a light hydrocarbon is used as a bridging liquid, an improved method for recovering said light hydrocarbons from the agglomerated coal particles, said method comprising:

introducing the agglomerated coal particles into a water bath in a chamber maintained at an elevated temperature;

advancing the agglomerated coal particles through an evaporation zone defined by a substantially horizontal surface which forms part of the chamber;

introducing steam upward through the horizontal perforate surface into the evaporation zone, whereby a vapor phase containing water vapor and light hydrocarbon vapor is carried into the chamber above the evaporation zone;

collecting the vapor phase from the chamber; and recovering the light hydrocarbon vapor from the vapor phase.

15. A method as in claim 14, wherein the agglomerated coal particles are introduced at an inlet end of the elongate evaporation zone and advanced axially to an outlet end of the evaporation zone, and wherein the rate at which the agglomerated coal particles are advanced and the rate at which steam is introduced to the evaporation zone are selected to remove substantially all the light hydrocarbons from the agglomerated coal particles.

16. A method as in claim 15, wherein the water bath has a depth in the range from about 50 mm to 300 mm.

17. A method as in claim 16, wherein the steam is at a temperature in the range from about 100° C. to 135° C. and a differential steam pressure in the range from about 1 kilopascal to 15 kilopascals is maintained.

18. A method as in claim 17, wherein the steam is introduced at a rate in the range from about 0.3 kg steam per kg of coal agglomerates (dry basis) to 1 kg steam per kg of coal agglomerates (dry basis).

19. A method as in claim 18, wherein the agglomerates are advanced over a length in the range from about 3 meters to 10 meters and at a rate in the range from about 0.1 m/min to 1 m/min.

20. A method as in claim 14, wherein the light hydrocarbons include primarily heptane, the water bath is about 50 millimeters to 300 millimeters deep, the steam is at a temperature in the range from about 100° C. to 135° C., and at a differential pressure across the apparatus in the range from about 1 kilopascal to 15 kilopascals, the steam is introduced at a rate in the range from about 0.3 kg of steam per kg of coal agglomerates (dry basis) to 1.0 kg of steam per kg of coal agglomerates (dry basis), and the agglomerates are advanced over a length in the range from about 3 meters to 10 meters and at a rate in the range from about 0.1 meter per minute to 1 meter per minute.

21. A method as in claim 14, wherein the chamber is maintained at an elevated temperature in the range from about 60° C. to 120° C. by steam addition.

22. A method as in claim 14, wherein the horizontal perforate surface has a length in the range from about 3 meters to 10 meters and a width in the range from about 1 meter to 3 meters.

23. A method as in claim 14, wherein the steam is introduced substantially uniformly over the entire bottom surface of the horizontal perforate surface.

* * * * *